United States Patent [19]

Gellman

[11] 4,176,756

[45] Dec. 4, 1979

[54] STOPPER LOCK FOR CULTURE BOTTLE

[75] Inventor: Barry N. Gellman, Wayne, N.J.

[73] Assignee: Becton, Dickinson and Company, East Rutherford, N.J.

[21] Appl. No.: 809,972

[22] Filed: Jun. 27, 1977

[51] Int. Cl.[2] ..... B65D 45/32

[52] U.S. Cl. ..... 215/274; 220/319; 215/DIG. 3; 285/419; 285/DIG. 22; 403/309; 403/344

[58] Field of Search ..... 215/274, 275, 277, 280, 215/287, DIG. 3; 220/319, 320, 324; 292/220, 256.6; 24/129 D, 248 SL, 249 SL, 255 SL; 285/373, 419, DIG. 22; 403/309, 313, 344; 47/41.12, 41.13

[56] References Cited

U.S. PATENT DOCUMENTS

| | | | |
|---|---|---|---|
| 40,292 | 10/1863 | Thompson | 215/277 |
| 2,747,760 | 5/1956 | Jacobson | 220/324 |
| 3,034,189 | 5/1966 | Twentier | 24/255 SL |
| 3,456,965 | 7/1969 | Gajewski | 285/419 |
| 3,653,528 | 4/1972 | Wimmer | 215/DIG. 3 |
| 3,711,632 | 1/1973 | Ghirardi | 285/419 |

*Primary Examiner*—Herbert F. Ross

*Attorney, Agent, or Firm*—Kane, Dalsimer, Kane, Sullivan & Kurucz

[57] ABSTRACT

A stopper lock adapted for application to a culture bottle and positioned to retain the stopper on the culture bottle. The lock includes a pair of lock halves with fastener structure. The lock halves have a configuration permitting their placement on the bottle to engage with the stopper and bottle and to lock the stopper in position in the bottle when the fastener structure couples the lock halves together while permitting access to the stopper with a cannula. The stopper lock is a one time use item which cannot be removed from the bottle except by destruction.

8 Claims, 5 Drawing Figures

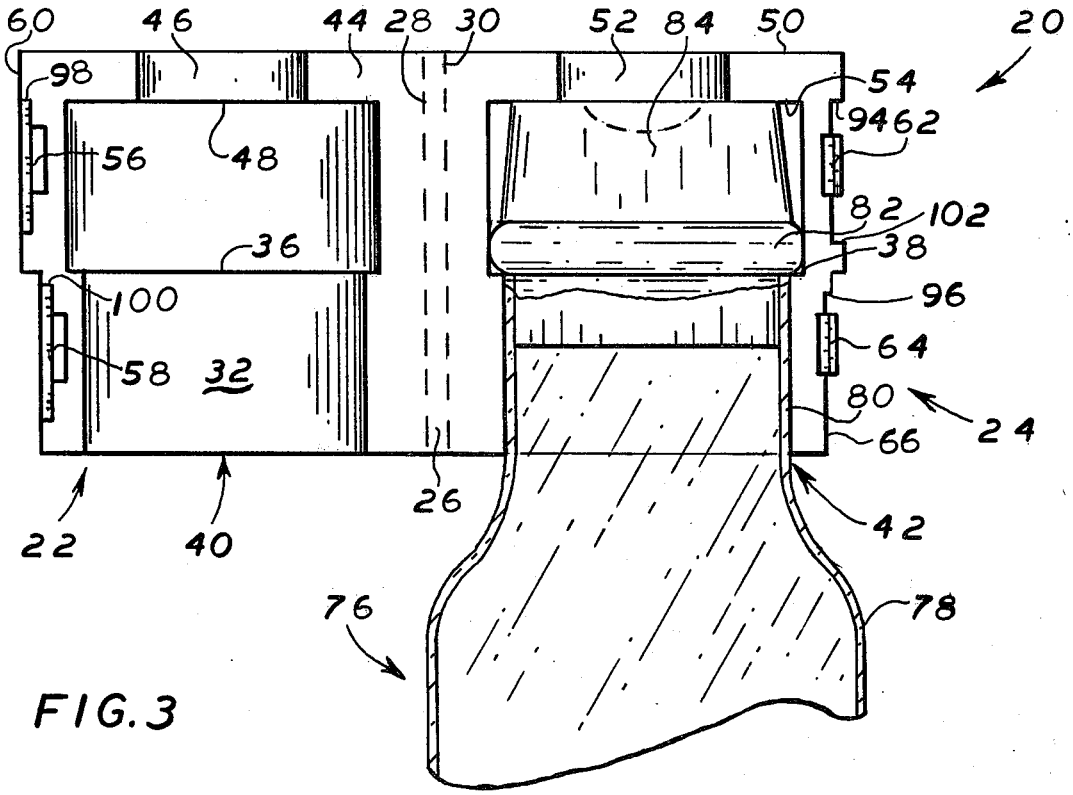
FIG. 3
FIG. 4
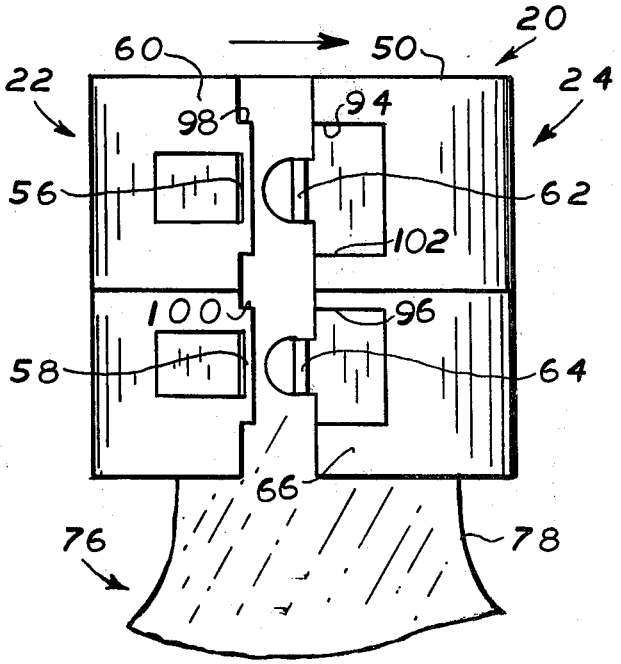
FIG. 5
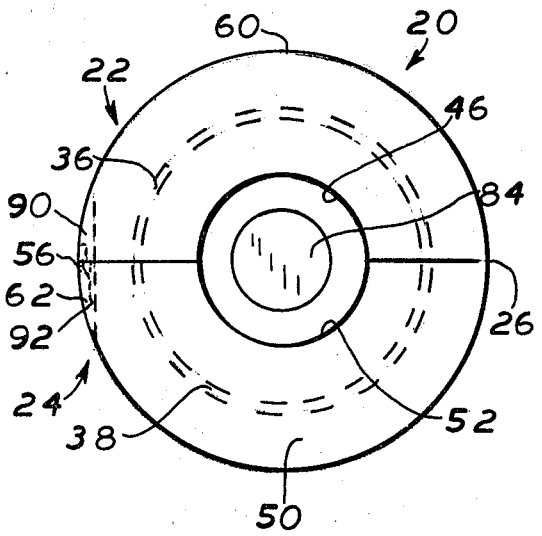

STOPPER LOCK FOR CULTURE BOTTLE

BACKGROUND OF THE INVENTION

There are a number of different types of culture bottles available which are used to contain media therein which are provided for growth of bacteria such as anaerobic aerogenic bacteria.

It is common practice to use a single venipuncture to take blood samples anaerobically or aerobically. The blood sample is taken directly into the culture bottle through a pieceable, self-sealing stopper. Usually a conventional double-ended needle in a holder is used with one end of the needle introduced into the vein of a patient and the other end of the needle passed through the stopper. Alternatively, a needle on one end of a piece of tubing is inserted through the stopper and a needle on the other end of the piece of tubing is introduced into the vein of a patient. After the blood sample is collected, the needles are removed from the patient's vein and the self-sealing stopper in the culture bottle. The bottle can be retained in the sealed condition or, if desired, can be vented through the stopper for the desired culture procedure. The media used are carefully controlled for the ability to grow organisms and are selected to show early growth from a positive specimen from minimal inoculation.

In known procedures for anaerobic bacterial growth, a plugged venting unit is used which incorporates a cannula and a wax plug encased in a polyethylene holder which is inserted into the stopper of the culture bottle. It is intended for this item to release the pressure build up by slowly forcing out the wax plug in the cannula. In time, the stopper takes a set around the cannula. If the vent is removed for subculturing, a small hole is left in the stopper. Small amounts of oxygen can enter the culture bottle through this hole. Also, when the bottle is inverted, media in the culture bottle will leak out. It is readily apparent that leakage of this type can contaminate the technologists and the general work area. Thus, it is clear that there is a need for further improvements in culture bottle technology.

SUMMARY OF THE INVENTION

With the above background in mind, it is among the primary objectives of the present invention to provide an inexpensive one-piece stopper lock which can be easily and efficiently coupled to a stoppered culture bottle to retain the stopper in the bottle during growth procedure such as in the growth of anaerobic aerogenic bacteria. The device is designed to lock around the stopper and bottle to guard against stopper blow-off during the production of anaerobic, aerogenic bacteria. The locking device is designed so that there is access to the stopper permitting introduction and removal of devices therethrough or coupling with a vent mechanism. The single piece stopper lock of the present invention is designed of two halves which are hinged together to facilitate engagement with the stoppered culture bottle to hold the stopper in locked position in the bottle. Fastening structure is on the one-piece device for interengaging the hinged valves and capturing the stopper in position in the culture tube. The one piece lock of the present invention incorporates no other parts or assemblies and allows easy access to the stopper through the central aperture in the top portion to obtain syringe samples without removal of the unit.

The hinged parts contain a laterally extending flange forming an upper wall with a central aperture. The flanges engages the stopper upper surface and the central aperture permits access to the stopper.

The device is particularly useful in retaining a stopper in the open end of a culture bottle during the growth of anaerobic aerogenic bacteria. it is designed to be formed of a one-piece molded plastic such as polypropylene and locks around the stopper and bottle to prevent stopper blow-off. Furthermore, there is no danger of leakage through the stopper in either direction during the culturing process.

The stopper lock is a one time use item which cannot be removed from the bottle except by destruction. It is capable of retaining the stopper on the culture bottle under extreme aerogenic conditions (i.e. clostridium perfringens) which can produce an internal bottle pressure of 65 psig. By not being removable, the stopper lock protects the user from inadvertently disengaging the lock and being harmed by the stopper which can blow out under pressure from within the bottle.

In summary, a stopper lock is provided which is adapted for application to a culture bottle in position to retain the stopper on the culture bottle. The lock includes a pair of lock halves with fastener means thereon. The lock halves have a configuration permitting their placement on the bottle to engage with the stopper and bottle and to lock the stopper in position in the bottle when the fastener means couples the lock halves together while permitting access to the stopper.

With the above objectives among others in mind, reference is made to the attached drawings.

BRIEF DESCRIPTION OF THE DRAWINGS

In the drawings:

FIG. 3 is a side elevation view thereof showing the lock of the invention partially positioned on a fragmentary portion of a stoppered culture bottle;

FIG. 4 is a side elevation view thereof showing the lock of the invention in fully assembled position locking the stopper on a fragmentary portion of a culture bottle; and FIG. 5 is a top view of the lock holding the stopper on the fragmentary portion of the culture bottle as depicted in FIG. 4.

DETAILED DESCRIPTION

Figure 1:
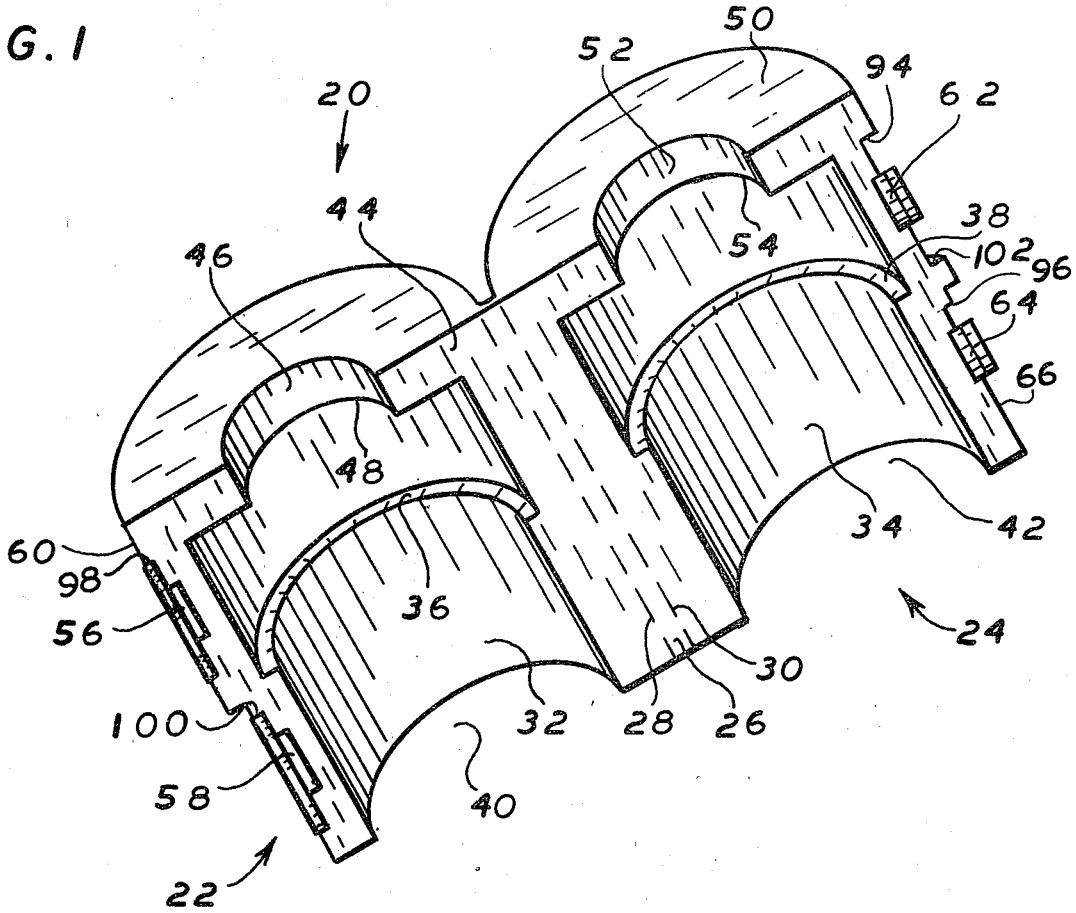
FIG. 1 is a perspective view of the lock of the invention in unfastened condition.
Figure 2:
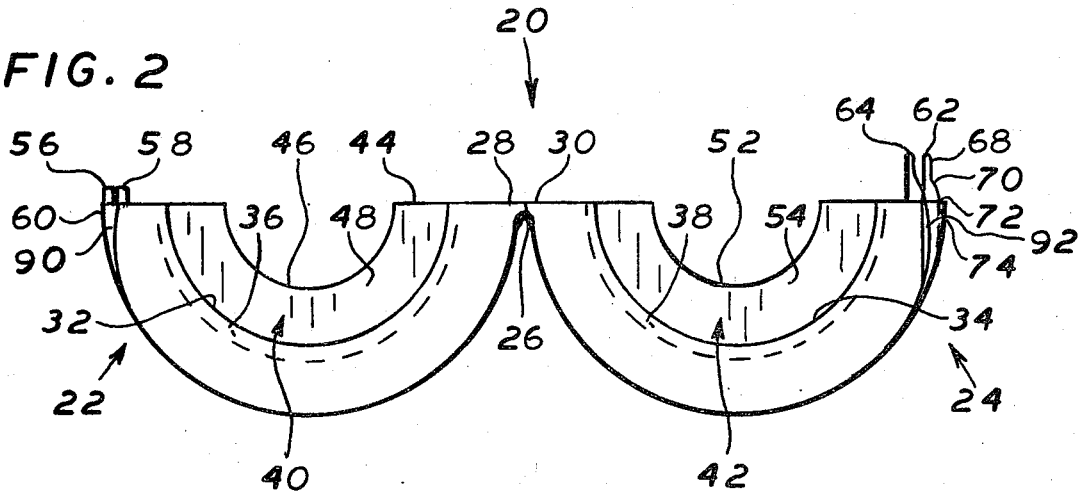
FIG. 2 is a bottom plan view thereof.

Lock 20 as depicted in FIGS. 1 and 2 in the unlocked condition includes a first lock half 22 and a second lock half 24. The lock halves are hinged together along a commonly joined area 26. The halves are integrally molded as a one piece unit in the depicted embodiment and can be formed of a conventional plastic material such as polypropylene. The hinge 26 is formed by providing an integral "living hinge" portion including fold lines 28 and 30 in the molding process which facilitates the rotation of mold halves 22 and 24 into alignment with one another to form the complete lock 20.

Each lock half includes a central semi-cylindrical portion with lock half 22 including central portion 32 and lock half 24 including central portion 34. Intermediate the top and bottom of the lock halves is a semi-circular shoulder to receive the lip of a culture bottle thereon for alignment and retention purposes. As depicted, lock half 22 includes shoulder 36 and lock half 24 includes shoulder 38 for this purpose. The bottom end of lock half 22 has a semi-circular opening 40 and similarly, the bottom end of lock half 24 has a semi-circular opening 42.

The upper end portion of lock half 22 includes an inwardly extending arcuate flange 44 with a central aperture 46 therein. Inwardly extending flange 44 forms a shoulder 48 on its under surface for engagement with the top of the stopper of a culture bottle as will be discussed in detail below. Similarly, lock half 24 includes an inwardly extending arcuate flange 50 with a central recess 52 and the flange forms an inwardly extending shoulder 54 with its under surface. As can be seen, when the lock halves are rotated into engagement with one another the flanges 44 and 50 form an inwardly extending circular wall with a circular aperture formed by openings 46 and 52. The under surfaces 48 and 54 of the flanges form an engaging surface with the upper edge of the culture bottle stopper as will be discussed below.

The fastening means for coupling halves 22 and 24 together provides the only difference between the lock halves.

Lock half 22 includes a pair of spaced slots 56 and 58 in its free longitudinal edge 60. The slots 56 and 58 are substantially rectangular in configuration and are spaced a predetermined distance upon along the longitudinal edge.

Lock half 24 has a pair of corresponding lateral projections 62 and 64 extending from its free longitudinal edge 66. Projections 62 and 64 are positioned for alignment with slots 56 and 58 respectively when the lock halves are rotated into coupling interengagement. To facilitate the interengagement therebetween, each lateral projection 62 and 64 includes a thin free end portion 68 tapering outward in an intermediate portion 70 to a wider portion 72 adjacent to edge 66. The wider portion 72 extends outwardly beyond the adjacent surface of the lock to form a shoulder 74. Thus, when the lock halves are rotated into engagement with one another narrower portions 68 and 70 of each projection 62 and 64 extend into the respective receiving slots 56 and 58 and as tapered portion 70 extends through the slot the resilient material of the lock 22 will be deformed slightly to permit wider portion 72 to pass through. Thereafter, the parts will return to the relaxed position whereupon the edges of slots 56 and 58 will snap into position behind shoulders 74 on projections 62 and 64, respectively, locking the lock halves together.

The outer surface of each lock half below the level of shoulders 36 and 38 has an inwardly tapered portion from the approximate central part toward the free longitudinal edges. Thus, tapered portion 90 terminates at free edge 60 and tapered portion 92 terminates at free edge 66. In this manner projection 64 mates with slot 58 inwardly of the mating between projection 62 and slot 56 to facilitate conformation of the lock with the stopper bottle and retention of the lock thereon.

Also to guard against relative displacement in the vertical direction, shoulders 94 and 96 are provided to engage with the upper edges 98 and 100 of the surfaces forming slots 56 and 58 respectively. A similar shoulder 102 is provided for the same purpose to guard against relative movement in the opposite direction by engagement with the lower edge of the surfaces forming slot 56.

In use, as depicted in FIGS. 3–5, the lock 20 is applied to a culture bottle 76 of the type described above with a wider body portion 78 tapering into a narrower neck portion 80 terminating in an upper rim 82 surrounding an open end. Positioned through the open end of the culture bottle is a resilient self-sealing stopper 84 which extends above rim 82 and below the rim into the neck 80 of the bottle.

In use, lock half 24 is brought into engagement with one side of the top portion of the bottle and stopper as depicted in FIG. 3 with recess 38 receiving rim 82 on the bottle therein. In this position, flange 50 overlies the top of stopper 84 and its under surface 54 engages with the top of the stopper. Central aperture 52 permits access to a portion of the top surface of the stopper and thereby permits access through the stopper into the interior of the culture bottle.

The next step is to rotate lock half 22 about hinge 26 until the fastener means on the lock halves come into interengagement locking the halves together. This condition is depicted in FIG. 4. The arrow depicts the direction of rotation of lock half 22 until it aligns itself with lock half 24 and projections 62 and 64 pass through apertures 56 and 58 until shoulders 74 engage with the edge of each aperture thus locking the halves together and accordingly locking the stopper in the culture bottle. As depicted from the top view of FIG. 5, lateral flanges 44 and 50 have formed an arcuate inwardly extending upper wall which engages with the upper surface of stopper 84 and cooperates with the engagement between the rim 82 and shoulders 36 and 38 to hold the stopper in the bottle. The central apertures 46 and 52 of the flanges form a circular aperture for access to the stopper therethrough. The result is a generally cylindrically shaped lock conforming to the configuration of the upper portion of the bottle 76 and the stopper 84 therein. In this manner, the stopper is retained in the bottle and is not permitted to be displaced therefrom while the central aperture in the lock permits access through the stopper to the interior of the bottle. The lock is a one time use item which cannot be removed from the bottle except by destruction.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A stopper lock adapted for application to a culture bottle in position to retain the stopper on the culture bottle comprising; a pair of lock halves, fastener means on the lock halves, the lock halves having a configuration permitting their placement on the bottle to engage with the stopper and bottle and to lock the stopper in position in the bottle when the fastener means couples the lock halves together while permitting access to the stopper, the lock halves being hinged together along one adjoining edge to facilitate their positioning on the bottle and stopper in the open position and then rotated into the closed position to lock the stopper in position on the bottle, the fastener means being located on the edge of each half opposite to the hinged edge, the fastener means including at least one laterally extending projection extending from the free edge of one body half, the projection having a narrow free end portion extending into a wider portion terminating in a longitudinal shoulder, at least one receiving slot positioned on the longitudinal edge of the other body half distal from the hinged end and having a size permitting insertion of the lateral projection therein until the projection snaps into position with the shoulder engaging the end wall of the slot thereby locking the lock halves together, the fastener means including permanent lock means to prevent reopening of the stopper lock after it has been closed and thereby providing a one time use stopper lock, the permanent lock means including each laterally extending projection extending from the free edge of one body half having a beveled portion between the narrow free end and the longitudinal shoulder and the opposite side of the shoulder from the beveled portion forming a wall, and each at least one receiving slot being formed by a tapered slot adjacent the longitudinal edge of the other body half and tapering between a wider lateral opening to a narrow opening at the point of the slot distal from the longitudinal edge and a guide bar on the longitudinal edge of the other body half and spaced from the lateral wall forming the entrance to the slot thereby providing an opening therebetween for introduction of the projection, the rear side of the bar forming a wall for interengagement with the wall on the longitudinal shoulder of the projection when the projection is inserted in the slot and to cooperate with the remainder of the slot to retain the projection in locked position therein.

2. An integrally formed one piece stopper lock for application to a culture bottle in position to retain the stopper on the culture bottle, the stopper being subjected to axial and radial forces, comprising; a pair of lock halves hinged together by means of an integral living hinge along one adjoining edge to facilitate their positioning on the joined together bottle and stopper in the open position and then rotated into the closed position to lock the stopper in position on the bottle, fastener means integrally formed on the lock halves and including permanent lock means in position to automatically interengage when the lock halves are rotated into the closed position to exert a circumferential retention force to prevent re-opening of the stopper lock after it has been closed and is subjected to radial forces on the stopper and thereby provide a one time use stopper lock, and the lock halves having a configuration including an upper flange extending inwardly to provide an aperture of lesser diameter than the bottle open end, a lower inwardly extending flange to engage the bottle neck below a projecting surface on said bottle neck permitting their placement on the bottle to engage with the stopper and bottle and exert an axial retention force to permanently lock the stopper in position in the bottle when the fastener means automatically couples the lock halves together and with the fastener means being positioned on the lock halves to generate the circumferential retention force holding the lock halves together perpendicular to the axial retention force of the lock halves holding the joined stopper and bottle together while permitting access to the stopper without the necessity of opening of the lock halves, and the combined circumferential and axial retention forces serving to accommodate substantial internal pressure without failure in both axial and circumferential directions.

3. The invention in accordance with claim 2 wherein the lock halves are substantially semi-cylindrical in configuration and together form an interior surface conforming to the substantially cylindrical exterior side wall surface of the stopper and bottle neck, the aperture of lesser diameter formed by the inwardly extending upper flange being substantially centrally located and permitting access to the stopper when the lock is in position holding the stopper in the culture bottle.

4. The invention in accordance with claim 3 wherein the lower inwardly extending flange on the substantially cylindrical lock halves engaging the bottle neck below a projecting surface on said bottle neck facilitates alignment of the lock with respect to the stopper and bottle in addition to assisting and maintaining the lock in fixed position on the stopper and bottle.

5. The invention in accordance with claim 2 wherein the fastener means is located on the edge of each half opposite to the hinged edge, the fastener means including at least one laterally extending projection extending from the free edge of one body half, the projection having a narrow free end portion extending into a wider portion terminating in a longitudinal shoulder, at least one receiving slot positioned on the longitudinal edge of the other body half distal from the hinged edge and having a size permitting insertion of the lateral projection therein until the projection snaps into position with the shoulder engaging the end wall of the slot thereby locking the lock halves together.

6. The invention in accordance with claim 5 wherein there are two lateral projections on the one body half spaced along the longitudinal edge thereof and two corresponding slots in the longitudinal edge of the other body half spaced along the edge in position so that each projection is aligned with each slot when the lock is positioned on the bottle and stopper.

7. The invention in accordance with claim 2 wherein the lock is formed of a molded polypropylene plastic material.

8. The invention in accordance with claim 5 wherein a plurality of radial shoulders are positioned on the one body half adjacent to the free longitudinal edge thereof in position to engage with surfaces forming the slot in the other body half and prevent relative axial movement therebetween.

* * * * *